US011602681B1

(12) United States Patent
Hammett

(10) Patent No.: US 11,602,681 B1
(45) Date of Patent: Mar. 14, 2023

(54) SPARRING ARMS HEAVY BAG BOXING APPARATUS

(71) Applicant: Joseph J Hammett, Ontario, CA (US)

(72) Inventor: Joseph J Hammett, Ontario, CA (US)

( * ) Notice: Subject to any disclaimer, the term of this patent is extended or adjusted under 35 U.S.C. 154(b) by 0 days.

(21) Appl. No.: 17/808,623

(22) Filed: Jun. 24, 2022

(51) Int. Cl.
*A63B 69/34* (2006.01)
*A63B 71/02* (2006.01)
*A63B 69/20* (2006.01)

(52) U.S. Cl.
CPC ..... *A63B 69/34* (2013.01); *A63B 69/215* (2022.08); *A63B 69/305* (2022.08); *A63B 2071/026* (2013.01); *A63B 2209/10* (2013.01); *A63B 2244/102* (2013.01)

(58) Field of Classification Search
CPC ..... A63B 69/34; A63B 69/20; A63B 69/203; A63B 69/205; A63B 69/206; A63B 69/215; A63B 69/22; A63B 69/222; A63B 69/305; A63B 2071/026; A63B 2209/10; A63B 2244/102
See application file for complete search history.

(56) References Cited

U.S. PATENT DOCUMENTS

| | | | | |
|---|---|---|---|---|
| 5,800,319 | A * | 9/1998 | Choate | A63B 69/34 482/83 |
| 6,063,011 | A * | 5/2000 | Pelchat | A63B 69/004 482/90 |
| 10,398,959 | B2 | 9/2019 | Hall | |
| 2002/0010057 | A1* | 1/2002 | Bouvier | A63B 69/305 482/86 |
| 2014/0080681 | A1* | 3/2014 | Knight | A63B 69/34 482/83 |
| 2015/0265898 | A1 | 9/2015 | Hall | |
| 2019/0118059 | A1 | 4/2019 | Partlo | |
| 2019/0143189 | A1* | 5/2019 | Elmore | A63B 69/004 473/438 |
| 2021/0008428 | A1 | 1/2021 | León | |
| 2021/0402276 | A1* | 12/2021 | Peyton | A63B 69/305 |
| 2022/0161116 | A1* | 5/2022 | Curry | A63B 69/20 |

* cited by examiner

*Primary Examiner* — Megan Anderson
(74) *Attorney, Agent, or Firm* — Carson Patents®; Gregory D Carson, Patent Attorney

(57) ABSTRACT

The sparring arms heavy bag boxing apparatus is a pair of simulated sparring opponent arms as a jab arm and a power arm of different lengths adjustably attached to a heavy bag with a stabilizing weight attached to the bottom of the heavy bag to stabilize the motion of the heavy bag for sparring practice even with out a training partner. The jab and power arms may optionally be weighed. Use of the sparring arms heavy bag boxing apparatus promotes a boxer's capacity to find distance and range with accuracy and precision.

18 Claims, 3 Drawing Sheets

SPARRING ARMS HEAVY BAG BOXING APPARATUS

TECHNICAL FIELD OF THE INVENTION

This invention relates generally to a Sparring Arms Heavy Bag Apparatus in the form of an attachable pair of mock opponent sparring arms and a stabilizing weight for attachment to a heavy bag for the purpose of enabling an individual user to create a realistic sparring partner for training to fight in the field of boxing, and training to fight in boxing.

This invention relates generally to a Sparring Arms Heavy Bag Apparatus in the form of an attachable pair of mock opponent sparring arms and a stabilizing weight for attachment to a heavy bag for the purpose of enabling an individual user to create a realistic sparring partner for training to fight in the field of marital arts and/or mixed martial arts, add training to fight in martial arts and/or mixed martial arts.

This invention relates generally to a Sparring Arms Heavy Bag Apparatus in the form of an attachable pair of mock opponent sparring arms and a stabilizing weight for attachment to a heavy bag for the purpose of enabling an individual user to create a realistic sparring partner for training to fight in any suitable fight training circumstance necessitating a mock or simulated training partner.

BACKGROUND

There are several kinds of simulated arms available for attachment to a heavy bag to facilitate training. What there is not, is a set of sparring arms which can be attached to a heavy bag, or other hanging device that simulate the motion of an actual sparring partner.

There are available today several products which amount to a pair of extensions or arms that can be attached to a heavy bag to attempt to mimic sparring with a real person. The nearly always present single (placed above) hanging position of a typical eighty pound (36.3 kilogram) heavy bag only enables wildly swinging motion of the heavy bag. Any sparring arms attached to the heavy bag accordingly swing wildly.

The attachable sparring arm type devices available today do not include any motion limiting elements to more closely simulate sparring against a real opponent. Further all devices today in effect require a training partner to assist in controlling the motion of a heavy bag with any extensions attached to mimic arms extended away from the heavy bag.

In light of the foregoing prior art, there is a need for a sparring arms heavy bag apparatus to better mimic the sparring motion of a real opponent and to enable a person to train with out the assistance of a training partner.

BRIEF SUMMARY OF THE INVENTION

According to one aspect of the present invention there is a sparring arms heavy bag apparatus in the form of a sparring device for augmenting a heavy bag having a top, a bottom, a first side opposite a second side, a diameter, and a circumference for fight training comprising a first strap having a length at least equal to said circumference positioned surrounding said heavy bag, a first sparring arm comprising a first semi-rigid tube having a first length at least equal to said diameter with a first end opposite a second end connectively attached to said first side, a second sparring arm comprising a second semi-rigid tube having a second length at least equal to said diameter with a third end opposite a fourth end connectively attached to said second side, and a stabilizer bag having a connector and not less than half of a kilogram of weighted particles contained within said connector operationally attached to said bottom of said heavy bag enabling free hanging motion of said stabilizer bag beneath said heavy bag enabling a weight stabling motion of said heavy bag resembling the motion of a sparring opponent.

According to a second aspect of the present invention there is a sparring arms heavy bag apparatus in the form of a sparring device for augmenting a heavy bag having a top, a bottom, a first side opposite a second side, a diameter, and a circumference for fight training comprising a first strap having a length at least equal to said circumference positioned surrounding said heavy bag, a first sparring arm comprising a first semi-rigid tube having a first length at least equal to said diameter with a first end opposite a second end connectively attached to said first side, a second sparring arm comprising a second semi-rigid tube having a second length at least equal to said diameter with a third end opposite a fourth end connectively attached to said second side, and a stabilizer bag having a connector and not less than half of a kilogram of weighted particles contained within said connector is operationally attached to said bottom of said heavy bag enabling placement of said stabilizer bag beneath said heavy bag on a floor.

According to a third aspect of the invention there is a sparring device wherein said first strap is further comprising a first end and a second end having a hook and loop closure enabling adjustable placement of said first strap.

According to a fourth aspect of the invention there is a sparring device further comprising a second strap positioned over said top having a third length enabling said second strap to surround said first strap extend over said top and surrounding said second strap.

According to a fifth aspect of the invention there is a sparring device wherein said second strap is further comprising a first end and a second end having a hook and loop closure enabling adjustable placement of said second strap.

According to a sixth aspect of the invention there is a sparring device further comprising a plurality of at least a first sparring arm strap and a second sparring arm strap wherein at least one sparring arm strap surrounds and encloses said first sparring arm and surrounding said first strap to attach and adjust the placement of said first sparring arm proximal to said first side of said heavy bag and at least one sparring arm strap surrounds and encloses said second sparring arm and surrounding said first strap to attach and adjust the placement of said second sparring arm proximal to said second side of said heavy bag, and/or wherein each sparring arm of said plurality of sparring arms further comprises a first end and a second end having a hook and loop closure enabling adjustable placement of said plurality of sparring arms.

According to a seventh aspect of the invention there is a sparring device further comprising a clip for attaching said stabilizer bag at said connector to said bottom of said heavy bag.

According to an eighth aspect of the invention there is a sparring device further comprising a first attachment device for connecting said stabilizer bag to said bottom of said heavy bag having a first ring opposite a second ring wherein said first ring is connectively attached to said bottom of said heavy bag and said second ring is connectively attached to said connector on said stabilizer bag, and/or wherein said first ring and said second ring further comprise a split for sliding in a connection strap, and/or further comprising a connection strap having a first end slid into said first ring and a second end having a grommet for connecting to a clip.

According to a ninth aspect of the invention there is a sparring device wherein said stabilizer bag further comprises an openable slit having a resealable opening enabling adding and removing said weighted particles.

According to a tenth aspect of the invention there is a sparring device wherein said first sparring arm further comprises a container having up to 1 kilogram of weighted particles contained therein An advantage of the stabilizing weight is the added control over the motion of the heavy bag. The addition of the stabilizing weight controls the motion of the heavy bag such that it more closely mimics the motion of an actual opponent.

An advantage of the stabilizing weight is the ability of one person to train alone because the motion of the heavy bag is controlled by the hanging or connected weight. The addition of the stabilizing weight controls the motion of the heavy bag such that one person may use the device of the present invention to train without the presence of another person.

The invention will now be described, by way of example only, with reference to the accompanying drawings in which:

DETAILED DESCRIPTION

The detailed embodiments of the present invention are disclosed herein. The disclosed embodiments are merely exemplary of the invention, which may be embodied in various forms. The details disclosed herein are not to be interpreted as limiting, but merely as the basis for the claims and as a basis for teaching one skilled in the art how to make and use the invention.

References in the specification to "one embodiment," "an embodiment," "an example embodiment," etcetera, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Figure 1:
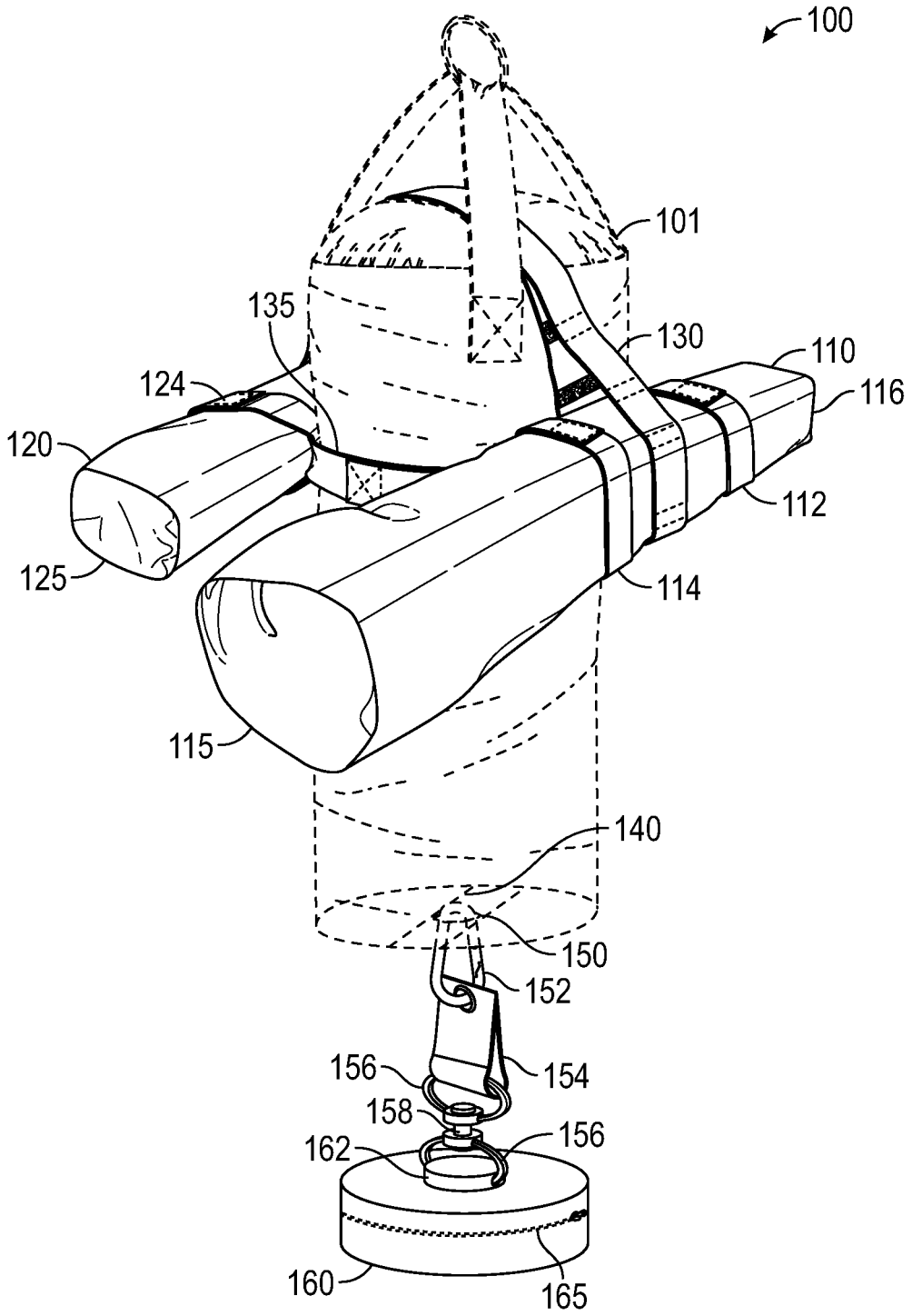
FIG. 1 shows a perspective view of the sparring arms and a sparring arms attachment device coupled with a stabilizing weight added to a heavy bag according to the invention.
Figure 2:
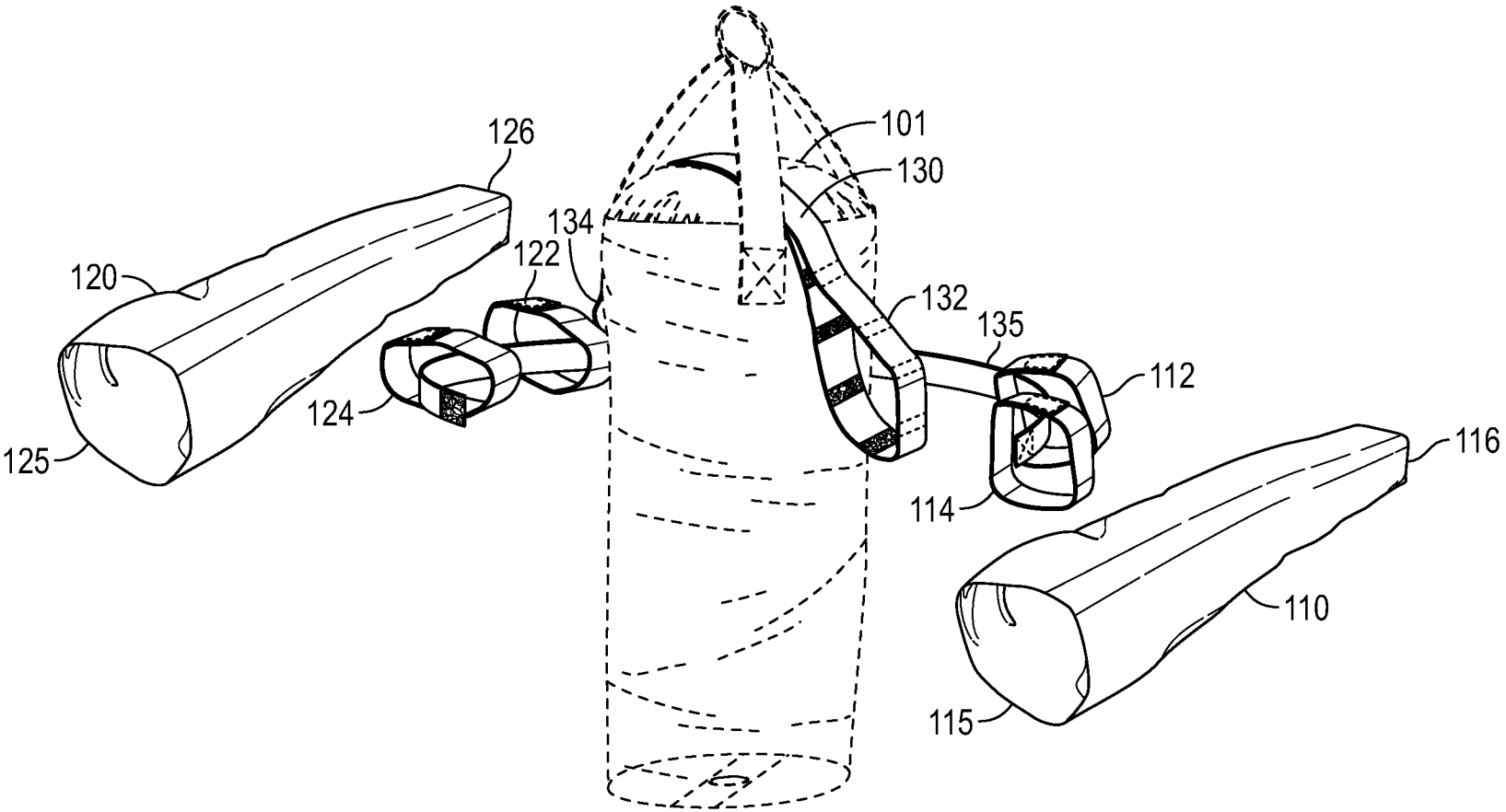
FIG. 2 shows an exploded view showing the sparring arms and a sparring arms attachment device according to the invention.
Figure 3:
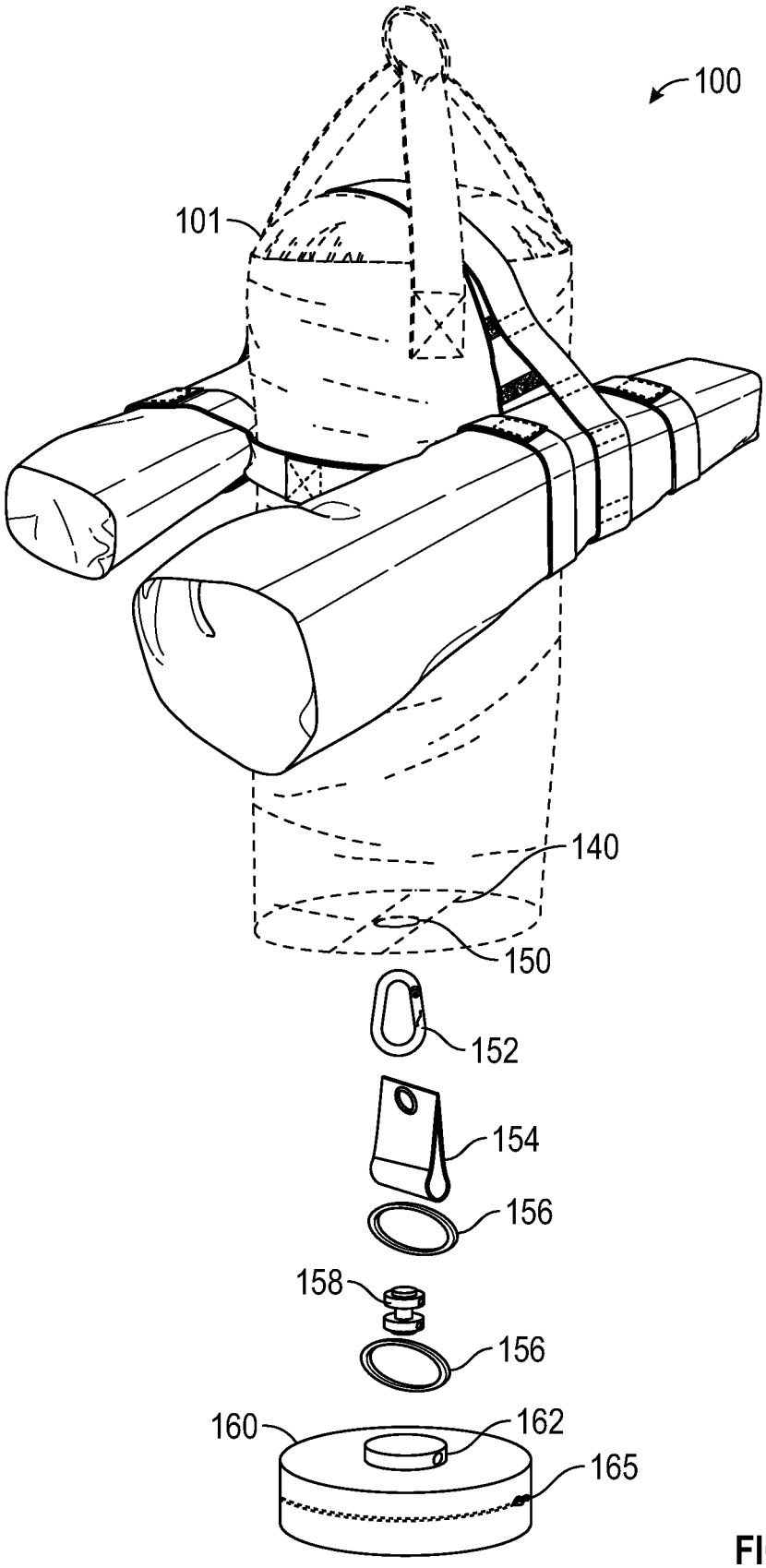
FIG. 3 shows an exploded view showing the stabilizing weight and various stabilizing weight attachment devices according to the invention.

Index of Labelled Features in Figures. Features are listed in numeric order. Referring to the Figures, there is shown in FIGS. 1, 2, and 3 the following features:

Element 100 which is a sparring arms heavy bag apparatus.

Element 101 which is a heavy bag.

Element 110 which is a right side sparring arm.

Element 112 which is a sparring arm strap.

Element 114 which is a sparring arm strap.

Element 115 which is a sparring arms sparring end.

Element 116 which is a sparring arms base or back end.

Element 120 which is a left side sparring arm.

Element 122 which is a sparring arm strap.

Element 124 which is a sparring arm strap.

Element 125 which is a sparring arms sparring end.

Element 126 which is a sparring arms base or back end.

Element 130 which is a sparring arm positioning strap placed over the top of a heavy bag.

Element 132 which is a sparring arm positioning strap shown to hold a sparring arm.

Element 134 which is a sparring arm positioning strap shown to hold a sparring arm.

Element 135 which is a sparring arm positioning strap surrounding a heavy bag.

Element 140 which is a strap on the bottom of a heavy bag.

Element 150 which is a stabilizing weight connection point on a strap on the bottom of a heavy bag.

Element 152 which is a carabiner (clip) for connecting a stabilizer weight to a strap on the bottom of a heavy bag.

Element 154 which is a strap for connecting a stabilizer weight to a strap on the bottom of a heavy bag.

Element 156 which is a ring for connecting a stabilizer weight to a strap on the bottom of a heavy bag, optionally with a swivel connector.

Element 158 which is a swivel connector for connecting a stabilizer weight to a strap on the bottom of a heavy bag.

Element 160 which is a stabilizer weight having a plurality of weighted particles contained therein.

Element 162 which is a stabilizer weight connection point.

Element 165 which is a stabilizer weight resealable opening for adding and removing weight from the stabilizer weight.

Note, all straps are shown with hook and loop type end connectors for connecting and/or adjusting the ends of that strap. Nearly any other available connector that does not create a safety hazard may be substituted.

The following describes the features of the present invention: a) dual, horizontal, directly opposing, out stretched arms that mimic a real boxing opponent; b) strap system that allows for attachment to a heavy bag and height adjustment; c) stabilizing weight suspended below or used to anchor a heavy bag to the floor with a tether strap to control motion and mimic a real fighting opponent. The apparatus of the present invention is to enhance the boxing heavy bag workout by emulating boxing with an another boxer.

The present invention is an accessory to the typical cylindrical boxing heavy (punching) bag. The present invention is made up of horizontal, directly opposing out stretched arms that mimic a real boxing opponent, it consists of five distinct elements, a) jab arm, b) power arm, c) main bag strap, d) arm straps, and e) height adjusting straps.

The stabilizer weight contains weighted particles such as sand and other small particulates of weight such as metal and plastic beads. Nearly any material is suitable. Up to 15 kilograms of weight are typically added to enable the desired amount of anchoring and or motion.

The present invention is an accessory to the typical cylindrical boxing heavy punching bag, consisting of two horizontal, directly opposing, out stretched arms that mimic a real boxing opponent. The sparring arms can consist of two dense foam rubber columns (the arms), two foam rubber wedges that are attached to the top (knuckles) of the columns and one side (thumb) on each column. A foam rubber semi-circle piece is attached to the front of the column (front of glove).

There are two distinct arms the jab arm, and the power arm. As determined by the left or right dominate nature of the opponent to be simulated, either a left or right side attached sparring arm might be the jab arm or the power arm.

In an embodiment of the sparring arms there are four specific foam rubber parts, for each arm that can be fashioned in most any suitable shape such as, but not limited to a cylinder, a cylinder with a front end larger than a back or rear end, a shape similar to that of a human arm with or without closed fist attached. The closed attached fist is not shown but may be at least the size and shape of a human hand in open or closed position with or without a glove.

In an embodiment the jab arm dimensions are those of a cylinder, log, column, or box 76.2 cm long, by 10.2 cm wide, and 10.2 cm deep, and the power arm dimensions are a cylinder, log, column, or box 55.9 cm long, by 10.2 cm wide, and 10.2 cm deep. The distance from the bottom of the heavy bag (not the board) is 60.96 cm. The distance from connecting strap on bottom of heavy bag to connector strap on top of stabilizer bag is 26.67 cm. A tension bolt anchoring the heavy bag will allow for some height adjustment of the stabilizer bag, for heavy bags hung up higher than 60.96 cm from the floor.

Regarding sparring arm assembly, the foam rubber pieces (thumb part, knuckle part, semi-circle part) are attached to the arm columns with ordinary sewing stick pins. First the arm columns are covered with a durable auto upholstery vinyl. Seams are sewn together with auto upholstery thread. Second piece of vinyl is sewn over top front and thumb-less side of column. Last piece of vinyl is sewn over thumb piece. Sewing stick pins are removed as each piece is attached.

Regarding the attaching straps, in order to attach sparring arms to a typical boxing heavy bag, there is a system of durable elastic straps. Strap system consists of main bag strap, which wraps completely around the heavy bag and is latched at the ends with industrial strength pieces of hook and loop closure, which holds the sparring arm straps which hold the sparring arms.

To attach the arm straps, before attaching the main bag strap to the heavy bag, the main bag strap is inserted through four of the arm straps, as well as the arm strap that is part of the height adjusting strap. Once the main bag strap is attached to the heavy bag, the arm straps are spread out equally on each side of the heavy bag. Recommended is two arm straps on each side 15-20 cm apart. Once these straps are in place, each sparring arm is inserted through two arm straps on each side of a heavy bag as well as the height adjusting strap arm strap. This elastic strap system securely holds the sparring arms to the typical boxing heavy bag.

Regarding the height adjusting strap, in order to adjust the height of the sparring arms a fifth arm strap has been attached to the height adjusting strap. The jab arm is inserted through the height adjusting arm strap. The height adjusting strap is then ran over the top of the heavy bag, draped down the opposite side of the heavy bag. At this point the height adjusting strap is slipped under the main bag strap where the power arm is located. The height adjusting strap wraps over the power arm. At this point the height adjusting strap is secured by hook and loop connection latches as it is ran back over the top of the heavy bag. The height adjusting strap will adjust up or down at least a meter.

According to a preferred embodiment, there is a sparring device for augmenting a heavy bag having a top, a bottom, a first side opposite a second side, a diameter, and a circumference for fight training comprising a first strap having a length at least equal to said circumference positioned surrounding said heavy bag, a first sparring arm comprising a first semi-rigid tube having a first length at least equal to said diameter with a first end opposite a second end connectively attached to said first side, a second sparring arm comprising a second semi-rigid tube having a second length at least equal to said diameter with a third end opposite a fourth end connectively attached to said second side, and a stabilizer bag having a connector and not less than half of a kilogram of weighted particles contained within said connector operationally attached to said bottom of said heavy bag enabling free hanging motion of said stabilizer bag beneath said heavy bag enabling a weight stabling motion of said heavy bag resembling the motion of a sparring opponent.

According to a preferred embodiment, there is a sparring device for augmenting a heavy bag having a top, a bottom, a first side opposite a second side, a diameter, and a circumference for fight training comprising a first strap having a length at least equal to said circumference positioned surrounding said heavy bag, a first sparring arm comprising a first semi-rigid tube having a first length at least equal to said diameter with a first end opposite a second end connectively attached to said first side, a second sparring arm comprising a second semi-rigid tube having a second length at least equal to said diameter with a third end opposite a fourth end connectively attached to said second side, and a stabilizer bag having a connector and not less than half of a kilogram of weighted particles contained within said connector is operationally attached to said bottom of said heavy bag enabling placement of said stabilizer bag beneath said heavy bag on a floor.

According to an alternate embodiment, there is a sparring device as in either preferred embodiment, wherein said first strap is further comprising a first end and a second end having a hook and loop closure enabling adjustable placement of said first strap.

According to an alternate embodiment, there is a sparring device as in either preferred embodiment, further comprising a second strap positioned over said top having a third length enabling said second strap to surround said first strap extend over said top and surrounding said second strap.

According to an alternate embodiment, there is a sparring device as in either preferred embodiment, wherein said second strap is further comprising a first end and a second end having a hook and loop closure enabling adjustable placement of said second strap.

According to an alternate embodiment, there is a sparring device as in either preferred embodiment, further comprising a plurality of at least a first sparring arm strap and a second sparring arm strap wherein at least one sparring arm strap surrounds and encloses said first sparring arm and surrounding said first strap to attach and adjust the placement of said first sparring arm proximal to said first side of said heavy bag and at least one sparring arm strap surrounds and encloses said second sparring arm and surrounding said first strap to attach and adjust the placement of said second sparring arm proximal to said second side of said heavy bag, and/or wherein each sparring arm of said plurality of sparring arms further comprises a first end and a second end having a hook and loop closure enabling adjustable placement of said plurality of sparring arms.

According to an alternate embodiment, there is a sparring device as in either preferred embodiment, further comprising a clip for attaching said stabilizer bag at said connector to said bottom of said heavy bag.

According to an alternate embodiment, there is a sparring device as in either preferred embodiment, further comprising a first attachment device for connecting said stabilizer bag to said bottom of said heavy bag having a first ring opposite a second ring wherein said first ring is connectively attached to said bottom of said heavy bag and said second ring is connectively attached to said connector on said stabilizer bag, and/or wherein said first ring and said second ring further comprise a split for sliding in a connection strap, and/or further comprising a connection strap having a first end slid into said first ring and a second end having a grommet for connecting to a clip.

According to an alternate embodiment, there is a sparring device as in either preferred embodiment, wherein said stabilizer bag further comprises an openable slit having a resealable opening enabling adding and removing said weighted particles.

According to an alternate embodiment, there is a sparring device wherein said first sparring arm further comprises a container having up to 1 kilogram of weighted particles contained therein An advantage of using there present invention includes, increasing cardio vascular fitness due to increased need to duck (bob and weave) moving side to side in order not to get hit by arms, increasing visual accuracy due to striking bag between out stretched arms and the ability to adjust height of arms.

An advantage of the sparring arms heavy bag apparatus is the enablement of more realistic sparring motion due to the addition of the stabilizer weight attachment enabling motion of the heavy bag either back and forth, side to side, or in both of those directions in the same embodiment.

An advantage of the sparring arms heavy bag apparatus is the enablement of more realistic sparring motion due to the addition of the stabilizer weight attachment. The stabilizer weight is positioned on the floor and connected to a heavy bag by a strap, or a set of connectors and a strap to enable motion either back and forth, side to side, or both back and forth and side to side to emulate the motion of an actual opponent.

An advantage of the sparring arms heavy bag apparatus is the height adjustment feature to accommodate kids. Also, the stabilizer bag may be used to hold a users feet down to facilitate sit-up exercises.

An advantage of the sparring arms heavy bag apparatus is that its use promotes a boxers capacity to find distance and range with accuracy and precision.

The invention has been described by way of examples only. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims.

Although the invention has been explained in relation to various embodiments, it is to be understood that many other possible modifications and variations can be made without departing from the spirit and scope of the invention.

The invention claimed is:

1. A sparring device for augmenting a heavy bag having a top, a bottom, a first side opposite a second side, a diameter, and a circumference for fight training comprising a first strap having a length at least equal to said circumference positioned surrounding said heavy bag, a second strap positioned over said top having a third length enabling said second strap to surround said first strap extend over said top and surrounding said second strap, a first sparring arm comprising a first semi-rigid tube having a first length at least equal to said diameter with a first end opposite a second end connectively attached to said first side, a second sparring arm comprising a second semi-rigid tube having a second length at least equal to said diameter with a third end opposite a fourth end connectively attached to said second side, and a stabilizer bag having a connector and not less than half of a kilogram of weighted particles contained within said connector operationally attached to said bottom of said heavy bag enabling free hanging motion of said stabilizer bag beneath said heavy bag enabling a weight stabling motion of said heavy bag resembling motion of a sparring opponent.

2. The sparring device of claim 1 further comprising a first attachment device for connecting said stabilizer bag to said bottom of said heavy bag having a first ring opposite a second ring wherein said first ring is connectively attached to said bottom of said heavy bag and said second ring is connectively attached to said connector on said stabilizer bag.

3. The sparring device of claim 2 wherein said first ring and said second ring further comprise a split for sliding in a connection strap.

4. The sparring device of claim 3 further comprising a connection strap having a first end slid into said first ring and a second end having a grommet for connecting to a clip.

5. The sparring device of claim 1 further comprising a plurality of sparring arm straps comprising a first sparring arm strap and a second sparring arm strap wherein at least one of said plurality of sparring arm straps surrounds and encloses said first sparring arm and surrounding said first strap to attach and adjust the placement of said first sparring arm proximal to said first side of said heavy bag and at least one sparring arm strap surrounds and encloses said second sparring arm and surrounding said first strap to attach and adjust the placement of said second sparring arm proximal to said second side of said heavy bag.

6. The sparring device of claim 5 wherein each sparring arm strap of said plurality of sparring arm straps further comprises a first end and a second end having a hook and loop closure enabling adjustable placement of said plurality of sparring arms.

7. The sparring device of claim 1 wherein said first strap is further comprising a first end and a second end having a hook and loop closure enabling adjustable placement of said first strap.

8. The sparring device of claim 1 wherein said second strap is further comprising a first end and a second end having a hook and loop closure enabling adjustable placement of said second strap.

9. The sparring device of claim 1 further comprising a clip for attaching said stabilizer bag at said connector to said bottom of said heavy bag.

10. The sparring device of claim 1 wherein said stabilizer bag further comprises an openable slit having a resealable opening enabling adding and removing said weighted particles.

11. A sparring device for augmenting a heavy bag having a top, a bottom, a first side opposite a second side, a diameter, and a circumference for fight training comprising a first strap having a length at least equal to said circumference positioned surrounding said heavy bag, a second strap positioned over said top having a third length enabling said second strap to surround said first strap extend over said top and surrounding said second strap, a first sparring arm comprising a first semi-rigid tube having a first length at least equal to said diameter with a first end opposite a second end connectively attached to said first side, a second sparring arm comprising a second semi-rigid tube having a second length at least equal to said diameter with a third end opposite a fourth end connectively attached to said second side, and a stabilizer bag having a connector and not less than half of a kilogram of weighted particles contained within said connector is operationally attached to said bottom of said heavy bag enabling placement of said stabilizer bag beneath said heavy bag on a floor.

12. The sparring device of claim 11 further comprising a plurality of sparring arm straps comprising a first sparring arm strap and a second sparring arm strap wherein at least one of said plurality of sparring arm straps surrounds and encloses said first sparring arm and surrounding said first strap to attach and adjust the placement of said first sparring arm proximal to said first side of said heavy bag and at least one sparring arm strap surrounds and encloses said second sparring arm and surrounding said first strap to attach and adjust the placement of said second sparring arm proximal to said second side of said heavy bag.

13. The sparring device of claim 12 wherein each sparring arm strap of said plurality of sparring arm straps further comprises a first end and a second end having a hook and loop closure enabling adjustable placement of said plurality of sparring arms.

14. The sparring device of claim 11 wherein said first strap is further comprising a first end and a second end having a hook and loop closure enabling adjustable placement of said first strap.

15. The sparring device of claim 11 wherein said second strap is further comprising a first end and a second end having a hook and loop closure enabling adjustable placement of said second strap.

16. The sparring device of claim 11 further comprising a clip for attaching said stabilizer bag at said connector to said bottom of said heavy bag.

17. The sparring device of claim 11 wherein said stabilizer bag further comprises an openable slit having a resealable opening enabling adding and removing said weighted particles.

18. The sparring device of claim 11 wherein said first sparring arm further comprises a container having up to 1 kilogram of weighted particles contained therein.

* * * * *